United States Patent [19]

Tuschy et al.

[11] 4,202,195

[45] May 13, 1980

[54] SKEW ROLLING MILL ROLLER

[75] Inventors: Eckhard Tuschy; Georg Wischmeyer; Walter Steinkamp, all of Osnabruck, Fed. Rep. of Germany

[73] Assignee: Kabel-und Metallwerke Gutehoffnungshuette AG, Fed. Rep. of Germany

[21] Appl. No.: 926,091

[22] Filed: Jul. 19, 1978

[30] Foreign Application Priority Data

Jul. 23, 1977 [DE] Fed. Rep. of Germany ..... 2733401

[51] Int. Cl.[2] ..... B21B 27/02

[52] U.S. Cl. ..... 72/78; 72/98; 72/100

[58] Field of Search ..... 72/78, 95, 96, 98, 99, 72/100

[56] References Cited

U.S. PATENT DOCUMENTS 293,165 2/1884 Haas ..... 72/100

OTHER PUBLICATIONS

A.P.C. Application of Ichikawa, Ser. No. 371,079, published 5/1943.

*Primary Examiner*—Lowell A. Larson
*Attorney, Agent, or Firm*—James C. Jangarathis

[57] ABSTRACT

The tapered working roller of a skew rolling mill is provided with a deformation surface in the form of a paraboloid and a smoothing surface at the end of smaller cross-section in the form of a technical hyperboloid.

3 Claims, 1 Drawing Figure

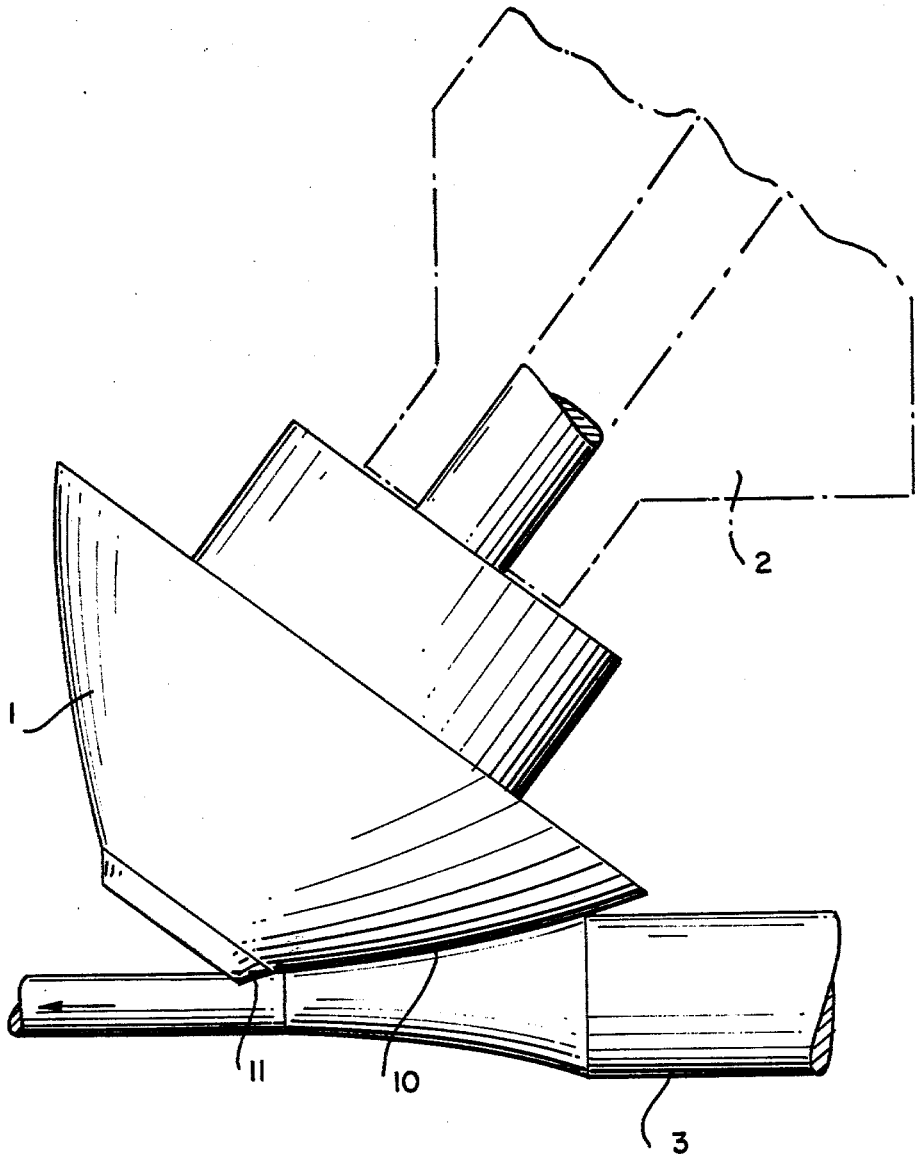
2
1
11
10
3

SKEW ROLLING MILL ROLLER

This invention relates to an improvement in a skew rolling mill of the type described in U.S. Pat. No. 3,735,617.

U.S. Pat. No. 3,735,617 describes a skew rolling mill which includes a driven roller carrier through which longitudinally extending material is moved, with the roller carrier being rotatably driven about the axis of material which is to be rolled. Three spaced frustroconically shaped working rollers are each rotatably driven in the roller carrier about an axis which intersects with the material to be rolled. The working rollers reduce the cross-section of the material, and as a result of the angular displacement of the rollers with respect to the axis of the material, the working rollers move such material.

It has been found that when this apparatus is used for forming nonferrous metals in regions with small dimensions, and in particular in the case of cold deformation, optimal rolling results are not achieved. For example, undesirable elevations which are quite marked and which have a helically shaped course, appear on the surface of the rolled stock. Furthermore, because the cross section decreases too much in those regions that are formed last, the roller slides quite severely on the rolled product, thereby reducing the quality of the rolled product.

In accordance with the present invention there is provided an improved tapered working roller for a skew rolling mill in which the working surface thereof is in the form or shape of a paraboloid to thereby provide a substantially equal or decreased deformation in the cross-section of the deformation taper of the rolled stock. In accordance with the invention, a more extensive deformation can be achieved and undesirable elevations can be eliminated or formed to an extent at which they can be easily removed by a drawing process.

The deformation in a skew rolling mill can be regarded as a direct sequence of discrete individual deformations. For example, in the case of a three-roller mill with five rotations for effecting the deformation, the reduction by rolling occurs 15 times one after the other. With the linear tapered rollers of the prior art the reduction of the diameter is proportional to the progress of the material in the deformation zone, i.e., the relative deformation becomes larger and larger, for example with the 15 rolling passes over the volume element. But this feature is precisely the one which unfavorably influences a formation process, particularly in cold deformation, but also in warm deformation. According to the teaching of the invention, working rollers of the skew rolling mill are designed in such a way that the relative formation does not increase, but remains the same, or still better decreases in correspondence with the strain hardening of the material. Through the above-mentioned measures, the rolling force remains the same, but a significantly higher degree of formation is achieved. Furthermore, the undesirable helical elevations do not occur to such a severe extent.

The helical elevations can be inhibited still further, as proposed according to another idea of the invention, by designing the surface of the roller at the end of smaller cross-section to provide a smoothing surface in the form of a technical hyperboloid.

Nearly optimal rolling results are achieved if the working surface of the working rollers is designed so that it approximately satisfies the formula $$f(r) = \frac{V_1(1+\alpha)}{a \cdot \phi_1} \cdot \frac{R_1^2}{r^2} \left( \frac{2\ln \frac{r}{R_1}}{\phi_1} \right)^{\alpha} \cdot \left[ \frac{2\ln \frac{r}{R_1}}{\alpha+1} + \frac{\left(2\ln \frac{r}{R_1}\right)^2}{(\alpha+1)(\alpha+2)} + \cdots \right]$$

In this formula, $V_1$ signifies the feeding speed of the stock; a is the frequency factor ($a=3/T$ with $T$=revolution time of the rotor); $\phi_1$ signifies the logarithmic reduction of cross-section of the first pass; $\alpha$=strain hardening exponent; $R_1$ signifies the radius of the rolled bar; and r=running ordinate of the rolling contour. The following holds for r:

$$r=R_1\exp(\phi_1/2\times n^k)$$

where n is the number of rolling passes for a volume element $$k=(1+\alpha)^{-1}$$

A skew rolling mill in which the working rollers were designed according to the above formula yielded excellent rolling results. The starting point here was that the slant position of the rolling axles exerts no significant effect on the result of rolling.

The invention is explained in more detail by means of the embodiment shown schematically in FIG. 1.

For the sake of clarity, the figure shows only one working roller 1 of a skew rolling mill as disclosed in U.S. Pat. No. 3,735,617.

Referring to the drawing, there is shown a tapered working roller 1 which is rotatably driven in a roller carrier 2 about an axis which intersects with the stock 3 to be rolled. The roller carrier is rotatably driven about the axis of stock which is rolled. The working rollers reduce the cross-section of the stock, and as a result of the angular displacement thereof with respect to the axis of the stock, the working rollers move the stock 3.

The working roller 1 essentially consists of a deformation part 10 and a smoothing part 11 at the end of roller 1 of smaller cross-section. While the smoothing part 11 has the form of a technical hyperboloid, the surface of the deformation part 10 is in the form of a paraboloid which satisfies the above formula.

We claim:

1. In a skew rolling mill for cross section reduction of an elongated stock as it moves along a longitudinal axis without rotation about such axis, comprising:

a roller support means mounted for rotation about said longitudinal axis;

a plurality of tapered working rollers mounted within said roll support means and symmetrically about said longitudinal axis, each of said rollers being mounted for rotation about a secondary axis which intersects the elongated stock;

primary means for rotating said roll support means in a first direction; and first intermediate means for rotating said rollers about said secondary axis and into the surface of said elongated stock for reducing the cross section of said stock, the improvement comprising said tapered working rollers each including a first surface having the shape of a paraboloid for substantially equal or decreasing deformation in the cross section of the deformation taper of said stock.

2. The skew rolling mill of claim 1 wherein each of said tapered working rollers has a second surface, immediately adjacent said first surface and defining the smaller end of said tapered working roller, having the shape of a technical hyperboloid for smoothing helically shaped protrusions and grooves caused by said first surface in the surface of the elongated stock during the cross section reduction thereof.

3. The skew rolling mill of claim 1, wherein the tapered working rollers each have a working surface that satisfies the formula:

$$f(r) = \frac{V_1(1+\alpha)}{a \cdot \phi_1} \cdot \frac{R_1^2}{r^2} \left( \frac{2\ln \frac{r}{R_1}}{\phi_1} \right)^{\alpha}.$$

-continued $$\left[ \frac{2\ln \frac{r}{R_1}}{\alpha+1} + \frac{\left(2\ln \frac{r}{R_1}\right)^2}{(\alpha+1)(\alpha+2)} + \cdots \right]$$

wherein $V_1$ is the feeding speed of the elongated stock as it moves along the longitudinal axis at a location prior to its engagement by said working rollers;

$a=3/T$ wherein T is the revolution time of said roller support means;

$\phi_1$ is the logarithmic reduction of the cross section of the first pass of said working surface of said roller about said stock;

$\alpha$=strain hardening exponent of said stock;

$R_1$ signifies the radius of said stock after its cross section has been reduced; and $$r=R_1\exp(\phi_1/2\times n^k)$$

where n is the number of rolling passes for a volume element and $$k=(1+\alpha)^{-1}.$$

* * * * *